US011174657B2

(12) United States Patent
Badewicz

(10) Patent No.: US 11,174,657 B2
(45) Date of Patent: Nov. 16, 2021

(54) MOTOR VEHICLE DOOR LOCK

(71) Applicant: Kiekert AG, Heiligenhaus (DE)

(72) Inventor: Thomas Badewicz, Essen (DE)

(73) Assignee: Kiekert AG, Heiligenhaus (DE)

( * ) Notice: Subject to any disclaimer, the term of this patent is extended or adjusted under 35 U.S.C. 154(b) by 693 days.

(21) Appl. No.: 16/062,126

(22) PCT Filed: Nov. 30, 2016

(86) PCT No.: PCT/DE2016/100559
§ 371 (c)(1),
(2) Date: Jun. 14, 2018

(87) PCT Pub. No.: WO2017/101901
PCT Pub. Date: Jun. 22, 2017

(65) Prior Publication Data

US 2018/0363325 A1 Dec. 20, 2018

(30) Foreign Application Priority Data

Dec. 14, 2015 (DE) ..... 10 2015 121 683.3

(51) Int. Cl.
*E05B 15/16* (2006.01)
*E05B 77/40* (2014.01)
(Continued)

(52) U.S. Cl.
CPC ..... *E05B 15/1635* (2013.01); *E05B 77/40* (2013.01); *E05B 79/08* (2013.01); *E05B 85/24* (2013.01); *E05B 85/243* (2013.01)

(58) Field of Classification Search
CPC ..... E05B 15/1635; E05B 79/08; E05B 77/40; Y10T 292/1047; Y10T 24/309; Y10T 24/45215; F16B 5/065
See application file for complete search history.

(56) References Cited

U.S. PATENT DOCUMENTS

2010/0199464 A1* 8/2010 Sano ..... F16B 21/10 24/289

FOREIGN PATENT DOCUMENTS

DE 4306142 9/1994
DE 102008034640 1/2010
(Continued)

OTHER PUBLICATIONS

International Search Report and Written Opinion for corresponding Patent Application No. PCT/DE2016/100559 dated Mar. 17, 2017.

*Primary Examiner* — Kristina R Fulton
*Assistant Examiner* — James Edward Ignaczewski
(74) *Attorney, Agent, or Firm* — Renner, Otto, Boisselle & Sklar, LLP

(57) ABSTRACT

A motor vehicle door lock having a locking mechanism substantially comprising a rotary latch and pawl as locking mechanism components. In addition, at least one lever is implemented as a constituent part of an actuating and/or locking lever chain. The motor vehicle door lock also has at least one bearing pin for supporting the relevant locking mechanism component and/or the lever in a housing. Also provided is a bearing sleeve, which can be inserted into an opening in the locking mechanism component and/or the lever and is built up from at least two sleeve elements for the bearing pin. According to the invention, one sleeve element has a socket reaching through the opening. The socket engages in a substantially dimensionally stable manner in a plug receptacle of the other sleeve element.

13 Claims, 3 Drawing Sheets

Figure 1:
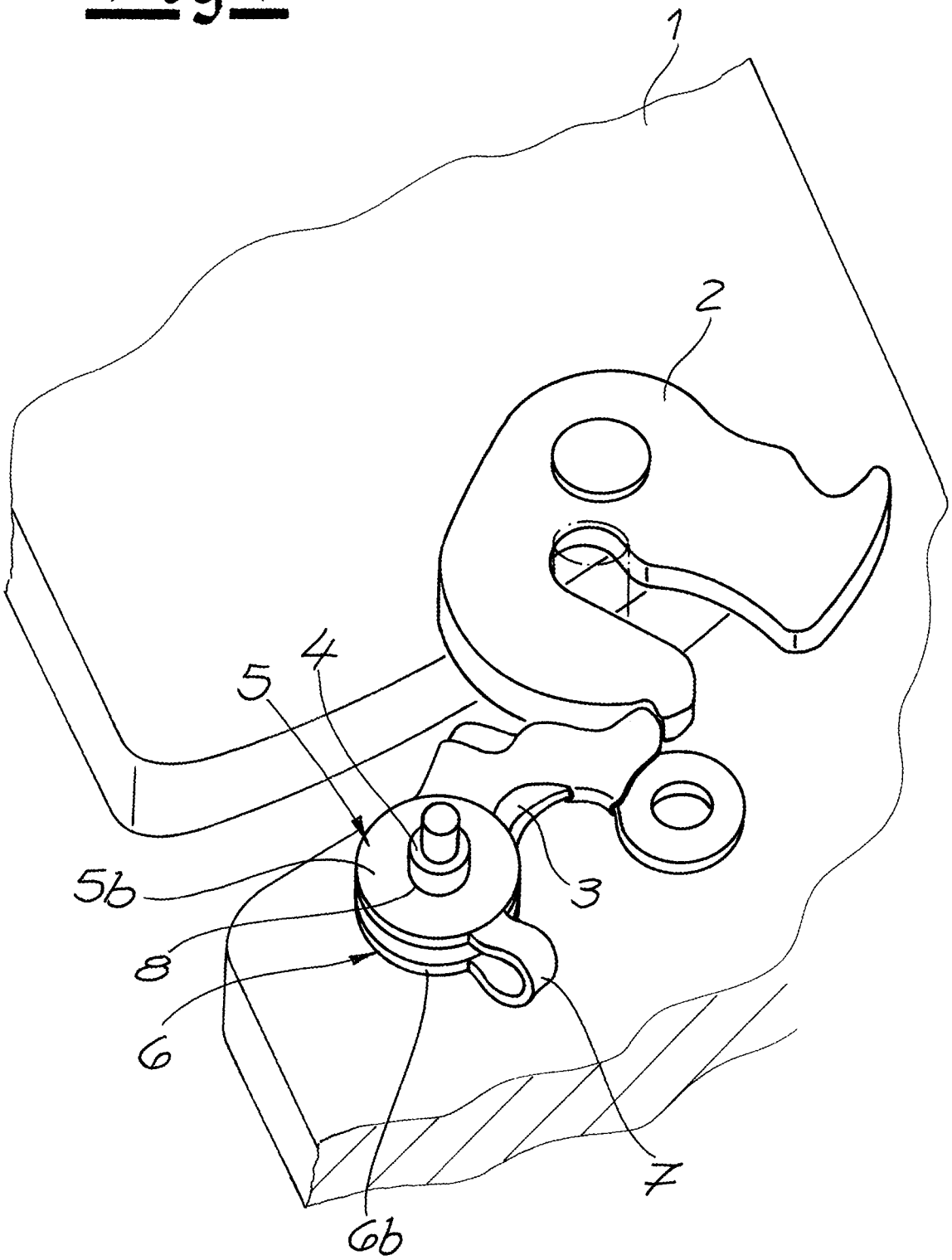

(51) Int. Cl.
*E05B 79/08* (2014.01)
*E05B 85/24* (2014.01)

(56) References Cited

FOREIGN PATENT DOCUMENTS

| | | | | | |
|---|---|---|---|---|---|
| DE | 102008034640 | A1 * | 1/2010 | ..... | E05B 85/26 |
| DE | 102012108882 | | 3/2014 | | |
| DE | 102012108882 | A1 * | 3/2014 | ..... | E05B 85/02 |
| JP | S61147878 | | 9/1986 | | |
| JP | H11172978 | | 6/1999 | | |
| JP | 2004169414 | | 6/2004 | | |
| JP | 2014062425 | | 4/2014 | | |

* cited by examiner

MOTOR VEHICLE DOOR LOCK

The invention relates to a motor vehicle door lock, with a locking mechanism predominantly consisting of a catch and a pawl as locking mechanism components, furthermore with at least one lever as a component of an operating and/or locking lever chain, furthermore with at least a bearing pin for the pivotable accommodation of the relevant locking mechanism component and/or the lever in a housing, and with a bearing sleeve which can be inserted into an opening of the locking mechanism component and/or the lever consisting of at least two sleeve elements for the bearing pin.

In the case of a motor vehicle door lock according to DE 10 2012 108 882 A1, it is proceeded in such a way that the lever there is pivotably accommodated in a housing on a bearing pin with intermediate switching of a bearing sleeve. The bearing sleeve is predominantly made of plastic and molded as a single component to the housing also made of plastic. Cost benefits are thus observed because the housing on the one hand and the bearing sleeve on the other hand are manufactured together.

Within the scope of the class-specific state of the art according to DE 10 2008 034 640 A1, it is proceeded in such a way that a locking mechanism component for a motor vehicle door lock is equipped with a cover element which covers at least a section of the basic body of the locking mechanism component. The cover element encompasses at least a basic body and has a hinge for this purpose. The hinge generally involves a film hinge. Furthermore, a detachable connection is provided for between the basic body and the cover element in the form of a clip connection. Elastically malleable deformation bodies are executed for this purpose.

The state of the art has substantially been proven if it involves providing an additional bearing sleeve for a bearing pin for the pivotable accommodation of the locking mechanism component or the lever in a housing. The bearing sleeve in fact ensures especially low-noise and safe operation. Furthermore, any wear can be minimized with the aid of the bearing sleeve. However, attachment and installation requires improvement in the state of the art.

Because the clip connection according to DE 10 2008 034 640 A1 corresponds to inevitable elastic deformations of the bearing sleeve. On the one hand, problems can result in installation and on the other hand damage can occur, for example if a spring tongue of the clip connection breaks. Furthermore, the risk exists of the individual components not connecting correctly in the attachment of the sheathing and tilting of the bearing sleeve can result under certain circumstances. The invention intends to provide an overall remedy here.

The invention is based on the technical problem of thus further developing a motor vehicle door lock of the construction initially described such that the installation is simplified and perfect fit of the bearing sleeve is guaranteed during operation.

In order to solve this technical issue, a class-specific motor vehicle door lock within the scope of the invention is characterized in that one sleeve element has a socket passing through the opening which substantially engages into a plug receptacle of the other sleeve element crucially in a dimensionally stable manner. The socket is configured lengthwise such that, in the mounted state, it protrudes at least slightly from the opening so that this protrusion is accommodated in a frictionally engaged manner in the plug receptacle.

In contrast to the class-specific state of the art according to DE 10 2008 034 640 A1, a clip connection is therefore explicitly dispensed with with relevant deformation in both sleeve elements for execution of the bearing sleeve. Instead, the socket and the plug receptacle are executed which are substantially coupled in a dimensionally stable manner in a frictionally engaged manner. Due to the dimensionally stable connection, any deformations of the socket and the plug receptacle are prevented. As a consequence hereof, the installation is initially simplified because a clip connection does not need to be executed, but instead a dimensionally stable push-in connection is present and observed.

Thus, within the scope of the invention the risk no (longer) exists of the sleeve elements being pushed or deformed or otherwise being unable to assume their functional position perfectly in the installation of the two sleeve elements on the locking mechanism component or lever. Instead, the socket is generally inserted into the opening of the lever or locking mechanism component and connected to the socket in a frictionally engaged manner.

The socket has a length which exceeds the material thickness of the relevantly equipped locking mechanism component or lever. Thus, the socket not only passes through the relevant opening in the locking mechanism component or lever, but also protrudes in respect of a surface of the locking mechanism component or lever and can engage with this protrusion into the socket of the other sleeve element adjacent to the relevant surface. This occurs in a dimensionally stably and frictionally engaged manner within the scope of the invention, i.e. without the plug receptacle or the socket being deformed.

Instead, the socket is held in the plug receptacle largely by (adhesive) frictional forces. In the present case, this is completely sufficient, especially as the relevant locking mechanism component or the lever is pivotably accommodated on the bearing pin and the bearing pin is fixed in the housing. Thus, the lever or the locking mechanism component cannot deflect axially and is fixed axially in the housing by means of the bearing pin. The same applies to the bearing sleeve which is also axially secured by the bearing pin and is fixed on the lever or locking mechanism component.

The housing can be a latch case or a latch lid or both in principle. The latch case is predominantly metallic and regularly accommodates the locking mechanism components. In contrast, the latch lid which is usually made of plastic accommodates the lever. In both cases, the bearing pin is anchored in the latch case or the latch lid for pivotable accommodation of the relevant locking mechanism component or the lever, so that the lever or the locking mechanism component is hereby axially secured.

The bearing sleeve is thus simultaneously held in position from the two sleeve elements. It is also ensured that the socket pushing through the opening of the locking mechanism component or lever retains its position and accommodates the bearing pin. Consequently, the socket ensures that a direct metallic contact does not take place between the bearing pin and the locking mechanism component or lever which is also usually made of metal. Because the two sleeve elements are typically made of plastic so that the desired low-noise operation is present. This all succeeds in conjunction with an especially simple and custom-fit installation and without the risk of one or both sleeve elements being shifted, slid or otherwise being unable to assume their functional position perfectly during their attachment on the locking mechanism component or lever. These are the fundamental advantages.

Generally, the socket has a polygonal external profile. Furthermore, the plug receptacle is typically equipped with a polygonal internal profile which is adapted to the relevant polygonal external profile of the socket. Thus, when the two sleeve elements are united the socket automatically engages with the polygonal external profile into the plug receptacle with the pertaining polygonal internal profile in a dimensionally stable and frictionally engaged manner. In this context, the respectively polygonal shape ensures that any rotations of the two sleeve elements against one another cannot or practically cannot occur.

Such rotations are possible by the bearing pin passing through the plug receptacle and being accommodated therein. If rotational movements are now transmitted to the socket by means of the bearing pin, these thus lead according to the invention to the socket leaving its position within the plug receptacle. Instead, the polygonal design of the external profile of the socket and also the internal profile of the plug receptacle ensures that such rotations can be accommodated in principle without the two sleeve elements leaving and giving up their functional position against one another and also in respect of the lever or locking mechanism component.

According to an especially preferred embodiment, the socket is an open cuboid standing on a base area of the pertaining sleeve element. Furthermore, the socket generally has rounded edges in each instance in the corner area on its external surface. Finally, the socket is advantageously equipped with a central boring to accommodate the bearing pin. i.e. the socket has a polygonal external profile and in particular a rectangular or quadratic external profile with rounded edges in the corner area in each instance. In contrast, the central boring to accommodate the bearing pin is typically cylindrical and adapted to the external diameter of the bearing pin from its internal diameter.

The plug receptacle on the other sleeve element is consequently formed as a rectangular and in particular a quadratic mounting in a pertaining base area. Furthermore, the plug receptacle also has rounded edges in each instance in the corner area and advantageously. Thus, the socket can be accommodated on one sleeve element easily and in a dimensionally stable manner in the plug receptacle of the other sleeve element adjusted to the external profile within the scope of a push-in connection without deformation.

In this context, it has proven especially beneficial if the two sleeve elements are coupled by means of a connecting bridge. Thus, the possibility exists of the two sleeve elements and the connecting bridge forming a single-component constructional element. The configuration as a plastic injection-molded component has proven especially beneficial here. In this context, it is also recommended if the connecting bridge is designed as a film hinge. Thus, the two sleeve elements can be placed in a hinge-type manner around the opening of the lever or the locking mechanism component to accommodate the bearing pin and can be connected in a dimensionally stable manner by means of the described push-in connection. The relevant lever of the locking mechanism component is thus equipped with the bearing sleeve as desired which is accommodated inside the bearing pin and is interposed between the bearing pin and the relevant locking mechanism component or lever. An especially durable and low-noise accommodation is thus provided. These are the fundamental advantages.

Figure 2:
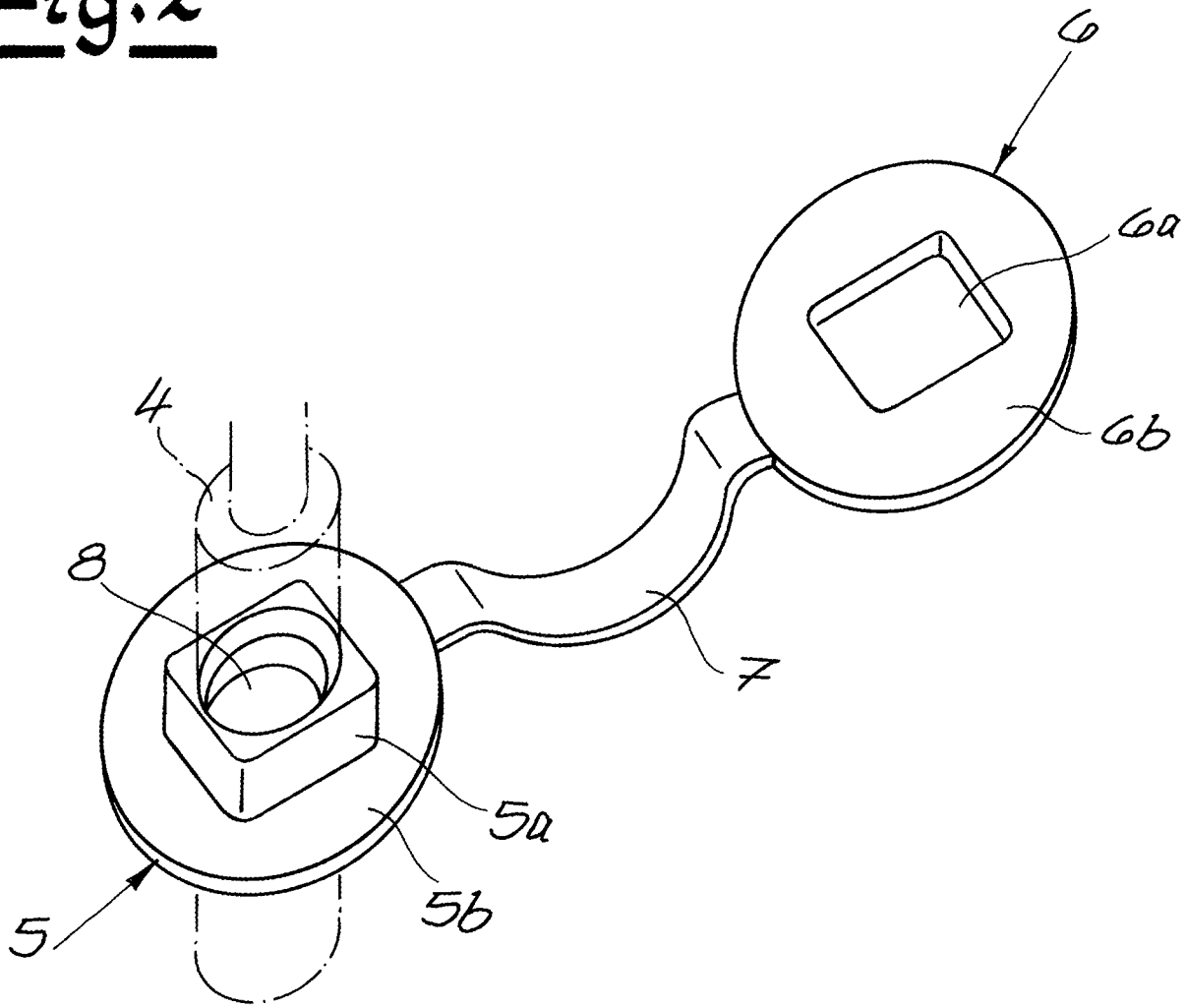
Figure 3:
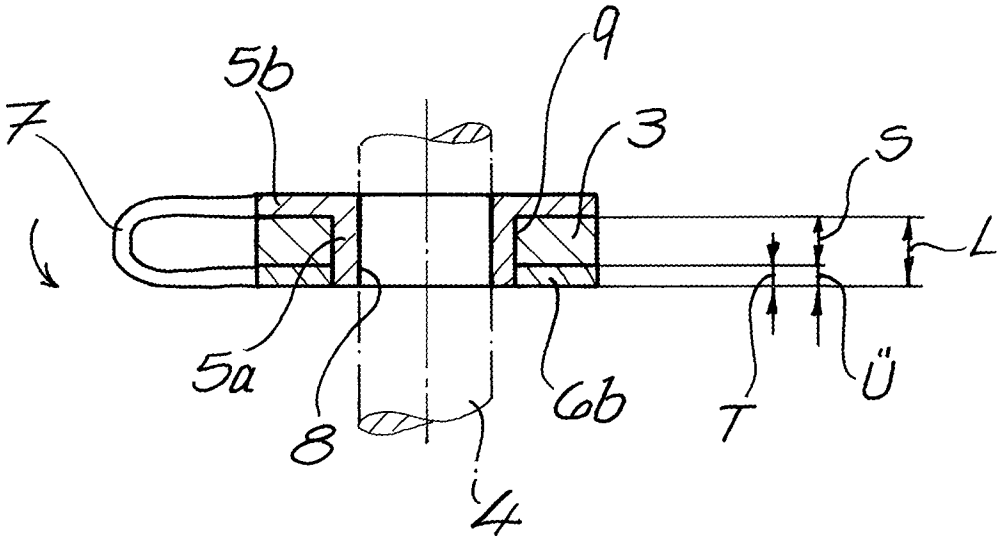

The invention is explained in further detail hereafter on the basis of a drawing which only constitutes an exemplary embodiment. The following are shown:

FIG. 1 a perspective view of sections of a motor vehicle door lock according to the invention, FIG. 2 the bearing sleeve to be installed on the locking mechanism component in detail constructed from the two sleeve elements and FIG. 3 a cross-section through the pawl with the bearing sleeve according to FIG. 1.

A motor vehicle door lock is diagrammatically illustrated in a perspective view in FIG. 1. This has a housing 1 which, in the present case, is designed as a metallic latch case and in which in the exemplary embodiment a locking mechanism 2, 3 consisting of a catch 2 and a pawl 3 is accommodated. In addition, further levers may also be accommodated in the housing 1 which is not illustrated, however. Furthermore, instead of the metallic latch case as a housing 1 a plastic housing lid can also be used. This is also not shown. The non-illustrated lever may be designed as a component of an operating and/or locking lever chain.

In the exemplary embodiment, a bearing pin 4 is provided for for the pivotable accommodation of the relevant locking mechanism component 3 in the housing 1. The locking mechanism component 3 within the scope of the example is, in the present case, the pawl 3. In principle, the catch 2 can also be accommodated, as described in further detail below.

In fact, a bearing sleeve 5, 6, 7 is provided for which is illustrated in detail in FIG. 2. The bearing sleeve 5, 6, 7 has two sleeve elements 5, 6 for the bearing pin 4. According to the invention, a sleeve element 5 has a socket 5*a* which engages into a plug receptacle 6*a* of the other sleeve element 6 in a substantially dimensionally stable and frictionally engaged manner. The socket 5*a* is one with a polygonal external profile. In fact, according to FIG. 2 the socket 5*a* is formed as an open cuboid standing on a base area 5*b* of the pertaining sleeve element 5.

It is apparent that the socket 5*a* has rounded edges in each instance on its external surface in the corner area. Furthermore, the socket 5*a* has a rectangular external profile which is quadratic according to the exemplary embodiment. The quadratic external profile is equipped with the already stated rounded edges in the respective corner area. Furthermore, the socket 5*a* has a central boring 8 which accommodates and leads the bearing pin 4. The central boring 8 is of a cylindrical design in the exemplary embodiment. Furthermore, the central boring 8 has an internal diameter which largely corresponds to the external diameter of the bearing pin 4 accommodated herein.

The plug receptacle 6*a* is equipped with a polygonal internal profile adapted to the external profile of the socket 5*a*. The plug receptacle 6*a* is a rectangular and in particular a quadratic fitting in a base area 6*b* of the pertaining sleeve element 6. The plug receptacle 6*a*, like the socket 5*a*, has rounded edges respectively in its corner areas.

Furthermore, it is apparent on the basis of FIG. 2 that the two sleeve elements 5, 6 are coupled by means of a connecting bridge 7. In the exemplary embodiment, the connecting bridge 7 is a film hinge. Thus, the two sleeve elements 5, 6 and the connecting bridge 7 or the film hinge 7 form a single-component constructional element. The present case in fact involves a plastic injection-molded component.

In order to install the thus executed bearing sleeve 5, 6, 7 from the two sleeve elements 5, 6 and the connecting bridge or film hinge 7 a sleeve element or the upper sleeve element 5 is typically initially inserted with its socket 5*a* into an opening 9 of the locking mechanism component 3, in the present case the pawl 3. Simultaneously, the other or lower sleeve element 6 is folded over in a hinge-like manner so that both sleeve elements 5, 6 are adjacent on opposite surfaces of the locking mechanism component 3.

As the socket 5*a* according to FIG. 3 has a length L which exceeds a material thickness S of the locking mechanism component or the pawl 3 the socket 5*a* protrudes over the lower surface of the locking mechanism component or the pawl 3 in FIG. 1. The pertaining protrusion Ü of the socket 5*a* with Ü=L−S thus has such dimensions that it corresponds as a maximum to the material thickness T of the base area 6*b* of the other or lower sleeve element 6 adjacent to this surface. Thus, the socket 5*a* can engage into the plug receptacle 6*a* in a dimensionally stable and frictionally engaged manner and is held by (adhesive) frictional forces as a result.

Thus, as in the state of the art, the risk no (longer) exists of the sleeve elements 5, 6 leaving their functional position or "sliding" against one another in the attachment of the two sleeve elements 5, 6. Instead, it is ensured that the socket 5*a* is perfectly held in the opening 9 of the locking mechanism component or the pawl 3. Thus, the boring 8 is provided inside the socket 5*a* to accommodate the bearing pin 4. Furthermore, the respectively polygonal socket 5*a* with its external profile and the also polygonal plug receptacle 6*a* with its internal profile guarantee that any rotations are hereby caught between the two sleeve elements 5, 6. i.e. the two sleeve elements 5, 6 retain their described functional position by encompassing the locking mechanism component or the pawl 3 as described. Thus, the desired low-noise accommodation of the locking mechanism component or the pawl 3 is provided compared to the housing 1.

The invention claimed is:

1. A motor vehicle door lock comprising:

a locking mechanism having a catch and a pawl as locking mechanism components, a bearing pin for pivotable accommodation of one of the locking mechanism components in a housing, and a bearing sleeve insertable into an aperture of the one of the locking mechanism components, the bearing sleeve having at least two sleeve elements for the bearing pin, wherein one of the at least two sleeve elements has a socket passing through the aperture which engages in a dimensionally stable manner into a plug receptacle of another one of the at least two sleeve elements, wherein the socket has a rounded regular polygonal external profile and wherein the plug receptacle has a rounded regular polygonal internal profile that is complementary to the rounded regular polygonal external profile of the socket, wherein the one of the at least two sleeve elements has a first base area having an outer first sleeve element perimeter that is equal in shape and size relative to an outer second sleeve element perimeter of a second base area of another one of the at least two sleeve elements.

2. The motor vehicle door lock according to claim 1, wherein the socket is formed as a cuboid having a central boring and standing on a base area of the one of the at least two sleeve elements.

3. The motor vehicle door lock according to claim 1, wherein the socket has rounded edges in corner areas on the rounded regular polygonal external profile.

4. The motor vehicle door lock according to claim 1, wherein the socket has a central boring to accommodate the bearing pin.

5. The motor vehicle door lock according to claim 1, wherein the plug receptacle is formed as a rectangular fitting in a base area of the one of the at least two sleeve elements.

6. The motor vehicle door lock according to claim 1, wherein the plug receptacle has rounded edges in corner areas.

7. The motor vehicle door lock according to claim 1, wherein the at least two sleeve elements are coupled by a connecting bridge.

8. The motor vehicle door lock according to claim 7, wherein the at least two sleeve elements and the connecting bridge form a single-component constructional element.

9. The motor vehicle door lock according to claim 8, wherein the single-component constructional element is a carbon injection-molded component.

10. The motor vehicle door lock according to claim 4, wherein the central boring has a shape that is different than a shape of the rounded regular polygonal external profile and the rounded regular polygonal internal profile.

11. The motor vehicle door lock according to claim 1, wherein the socket is formed of a plurality of side surfaces that are connected by rounded corners to define the rounded regular polygonal external profile.

12. The motor vehicle door lock according to claim 11, wherein the plurality of side surfaces form a closed boundary around a central boring that receives the bearing pin, the central boring being closed to outside the side surfaces.

13. The motor vehicle door lock according to claim 11, wherein all of the plurality of side surfaces have a same shape and size.

* * * * *